US007848666B2

(12) United States Patent
Onishi

(10) Patent No.: US 7,848,666 B2
(45) Date of Patent: Dec. 7, 2010

(54) IMAGE FORMING APPARATUS AND IMAGE FORMING METHOD

(75) Inventor: Kei Onishi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/391,281

(22) Filed: Feb. 24, 2009

(65) Prior Publication Data

US 2009/0220252 A1 Sep. 3, 2009

Related U.S. Application Data

(60) Provisional application No. 61/032,377, filed on Feb. 28, 2008.

(51) Int. Cl.
*G03G 15/08* (2006.01)

(52) U.S. Cl. ..... 399/27; 399/92

(58) Field of Classification Search ..... 399/27, 399/91, 92, 98, 99
See application file for complete search history.

(56) References Cited

U.S. PATENT DOCUMENTS 6,813,457 B2 * 11/2004 Yoshiki ..... 399/92
7,043,172 B2 * 5/2006 Koshimura et al. ..... 399/99

FOREIGN PATENT DOCUMENTS

JP 2002-268482 9/2002

* cited by examiner

*Primary Examiner*—Hoang Ngo
(74) *Attorney, Agent, or Firm*—Turocy & Watson, LLP

(57) ABSTRACT

A control unit separately drives an image carrier driving unit that drives an image carrier motor, a developing roller driving unit that drives a developing roller motor, a developer stirring member driving unit that drives a developer stirring member motor, and a fan driving unit that drives a fan motor. The control unit causes the fan driving unit to operate if the image carrier driving unit or the developer stirring member driving unit is operating.

20 Claims, 7 Drawing Sheets

IMAGE FORMING APPARATUS AND IMAGE FORMING METHOD

CROSS-REFERENCE TO RELATED APPLICATION

The present application claims priority under 35 U.S.C. 119 to U.S. Provisional Application Ser. No. 61/032,377, entitled ELECTROGRAPHIC IMAGE FORMING APPARATUS, to Onishi, filed on Feb. 28, 2008, the entire disclosure of which is incorporated herein by reference.

TECHNICAL FIELD

The present invention relates to an electrographic image forming apparatus and image forming method.

BACKGROUND

When a developing device of an image forming apparatus is driven, toner that is not sufficiently charged is scattered around a photoconductor and a magnet roller. A duct is attached to the container of the developing device. Alternatively, a duct is formed in the container of the developing device by the wall surface of the container.

One end of the duct is opened into the container. At the other end of the duct, a fan for sucking scattered toner is provided. The fan is driven by a fan motor.

The fan motor is controlled by a central processing unit (CPU) via a motor driver such as an integrated circuit (IC).

Conventionally, an image forming apparatus is proposed which sucks scattered toner and thereby prevents contamination due to the toner in and out of the apparatus (JP-A-2002-268482).

JP-A-2002-268482 discloses that a fan of a flow path unit which serves as an air flow path is actuated synchronously with a development driving system motor interlocked with a developing device unit.

Both a photoconductive drum and a magneto roller of a developing device receive a rotational driving force from one main motor via a gear and so on. The shaft, gear and belt of the main motor constitute a driving force transmission mechanism that provides the driving force of the main motor to the photoconductive drum.

The main motor is controlled by the CPU via another motor driver which is different from the motor driver of the fan motor.

A developer stirring member that stirs toner is provided in the developing device. The developer stirring member is a mixer. The mixer has a shaft and a blade member for stirring toner.

The developer stirring member receives a rotational driving force from the main motor via the driving force transmission mechanism. When the magnet roller rotates, the developer stirring member rotates together with the magnet roller.

A toner cartridge is attached to the developing device via a toner replenishment path. A toner replenishment mechanism that supplies toner is provided in the toner cartridge. The toner replenishment mechanism is driven by a toner replenishment motor via the driving force transmission mechanism.

Conventionally, in the image forming apparatus, the photoconductive drum, the magnet roller and the developer stirring member share the main motor.

During printing, the CPU causes all of the photoconductive drum, the magnet roller and the developer stirring member to operate. During the period after one sheet of paper is carried and before the next sheet is carried, the CPU instructs the motor driver of the main motor to rotate the main motor.

As printing is finished, the CPU instructs the motor driver of the main motor to stop rotation of the photoconductive drum, the magnet roller and the developer stirring member.

During the period when a print job is not executed after processing to carry a sheet is finished, the CPU carries out forced replenishment of the developing device with a developer. During the period after the previous print job is finished and before the next print job starts, the CPU causes the toner replenishment mechanism to carry out follow-up toner replenishment.

The CPU is enabled to read concentration information from a toner concentration sensor provided within the developing device. If the CPU determines that the toner concentration is low, the CPU changes the operation mode of the developing device to a forced toner replenishment mode. Also in the forced toner replenishment mode, the CPU causes the toner replenishment mechanism to carry out toner replenishment.

In the image forming apparatus according to the conventional example, the CPU controls the motor driver of the fan motor and the motor driver of the main motor so that on and off timing of the operation of the fan as a scattered toner suction member coincides with on and off timing of the operation of the driving force transmission mechanism.

After driving of the photoconductive drum is stopped, the photoconductive drum continues rotating for a predetermined time because of inertia. Since the photoconductive drum is a component to be replaced periodically, the time for which the photoconductive drum continues rotating should be minimized.

Recently, in the electrographic printing device, the CPU is required to carry out processing to minimize the idling time of a periodically replaced component, when operating in the forced toner replenishment-mode. The CPU drives the developer stirring member while keeping the photoconductive drum and the magnet roller in non-operating state.

For example, CPU controls a one-way clutch in the driving force transmission mechanism and thereby causes only the developer stirring member to operate, of the photoconductive drum, the magnet roller and the developer stirring member.

In this case, the CPU gives an instruction to the motor driver of the main motor so that the operation of the photoconductive drum becomes off, the operation of the magnet roller becomes off and the operation of the developer stirring member becomes on. The CPU also gives a control instruction to the motor driver of the fan motor so that the operation of the fan motor becomes on.

The on and off timing of the operation of the fan is the same as the on and off timing of the operation of the driving force transmission mechanism. During printing, the photoconductive drum is rotated by the main motor and therefore also the developer stirring member is rotated by the main motor.

However, in the forced toner replenishment mode, the CPU cannot rotate the developer stirring member alone.

Consequently, scattered toner generated in the developing device due to the rotation of the developer stirring member cannot be sucked through the duct.

SUMMARY

It is an object of the present invention to provide an image forming apparatus which enables prevention of scattering of toner in the machine and which forms an image on a recording medium.

According to an aspect of the invention, an image forming apparatus includes an image carrier, an image carrier driving unit that drives an image carrier motor, a container which contains a developer, a developing roller provided in the container, a transfer device that transfers a developer image generated on the image carrier by the developing roller to a recording target medium, a developing roller driving unit that drives a developing roller motor, a developer stirring member rotatably provided in the container, a developer stirring member driving unit that drives a developer stirring member motor, a duct that has a suction port and a discharge port and guides air including the developer scattered in the container from the suction port to the discharge port, a fan provided in a path through which air flows, a fan driving unit that drives a fan motor, and a control unit that separately drives the image carrier driving unit, the developing roller driving unit and the developer stirring member driving unit, and causes the fan driving unit to operate if the image carrier driving unit or the developer stirring member driving unit is operating.

DETAILED DESCRIPTION

Figure 1:
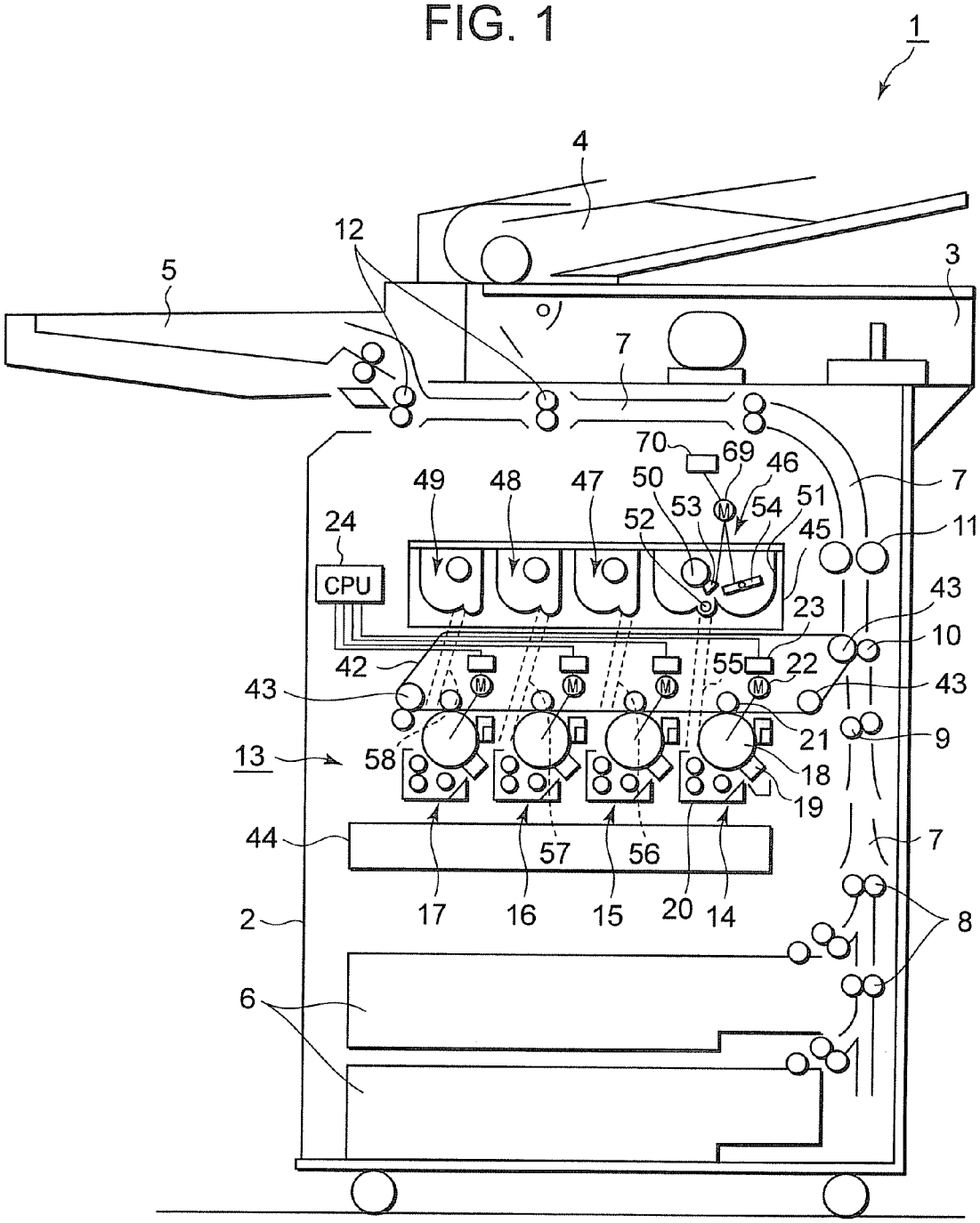
FIG. 1 shows a configuration of a color copy machine.

Throughout this description, the embodiments and examples shown should be considered as exemplars, rather than limitations on the apparatus and methods of the present invention.

Hereinafter, an image forming apparatus and an image forming method will be described in detail with reference to the attached drawings. In the drawings, the same elements are denoted by the same reference numerals and the description of the same parts will not be repeated.

An image forming apparatus according to an embodiment is a four-drum tandem color copy machine.

FIG. 1 shows a configuration of the color copy machine. A color copy machine 1 is provided with a casing 2, a scanner 3, an automatic document feeder 4, and a paper discharge tray 5.

The scanner 3 is provided on top of the casing 2 and optically scans image information including letters from an original. The automatic document feeder 4 automatically sends an original to the scanner 3.

Two paper feed cassettes 6 are provided in a lower part of the casing 2. A carrying path 7 is defined between the exit of the paper feed cassettes 6 and the paper discharge tray 5.

In the carrying path 7, plural paper feed rollers 8, a registration roller 9, a transfer roller 10, a fixing device 11 and plural paper discharge rollers 12 are provided sequentially from the bottom.

An image forming unit 13 is provided in the middle of the casing 2.

The image forming unit 13 has a first image forming unit 14 that forms a black image, a second image forming unit 15 that forms a cyan image, a third image forming unit 16 that forms a magenta image, and a fourth image forming unit 17 that forms a yellow image.

The first image forming unit 14 has a photoconductive drum 18, a charger 19, a developing device 20 and an intermediate transfer roller 21.

The photoconductive drum 18 is an image carrier on which an image is carried. The photoconductive drum 18 is rotated by a motor 22. The motor 22 is controlled by a CPU 24 via a motor driver 23. An IC is used for the motor driver 23.

Here, the motor 22 is an image carrier motor. The motor driver 23 is an image carrier driving unit. The CPU 24 is a micro processing unit (MPU). The CPU 24, a read only memory (ROM) and a random access memory (RAM) realize the functions of the control unit.

The motor driver 23 rotationally drives the motor 22 forward and backward. The motor driver 23 decides the rotating position of the photoconductive drum 18. The motor driver 23, and a gear and a belt, not shown, constitute a driving force transmission mechanism.

The charger 19 uniformly charges the outer circumferential surface of the photoconductive drum 18.

The developing device 20 develops, with toner, an electrostatic latent image formed on the outer circumferential surface of the photoconductive drum 18.

Figure 2:
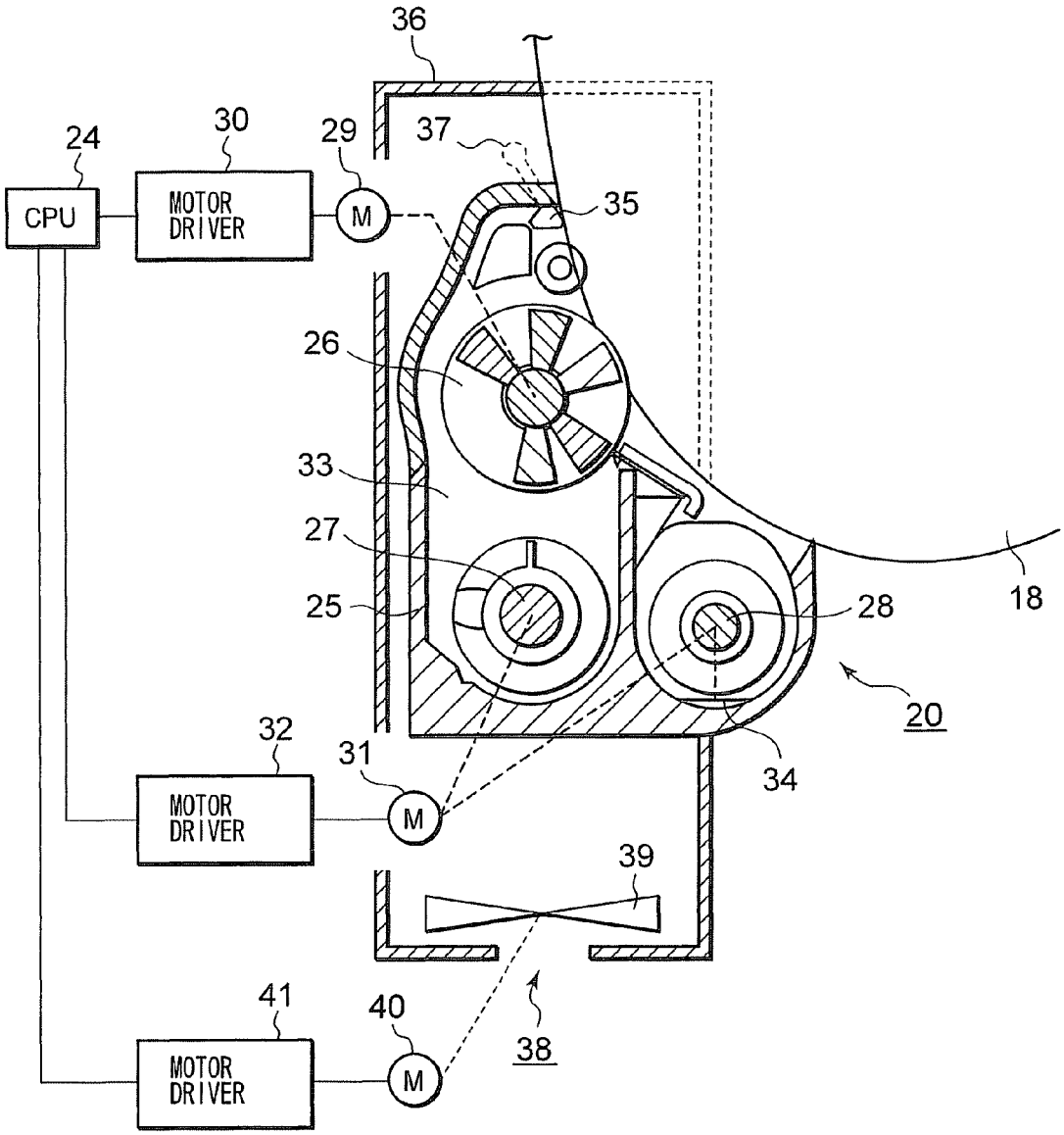
FIG. 2 is a longitudinal sectional view of a developing device.

FIG. 2 is a longitudinal sectional view of the developing device 20. In FIG. 2, the elements denoted by the same reference numerals as described above refer to the same elements.

In a container 25 of the developing device 20, a two-component developer including carrier and toner is contained. In the container 25, a cylindrical magnet roller 26 facing the photoconductive drum 18 is provided, and mixers 27 and 28 are provided, each of which stirs the developer.

The magnet roller 26 is a developing roller. Each of the mixers 27 and 28 is a developer stirring member.

The magnet roller 26 supplies the developer to the photoconductive drum 18 by using a magnetic force generated by five magnetic poles. The magnet roller 26 is rotated by a gear attached to a motor 29.

The motor 29 is a developing roller motor. The motor 29 is driven by the CPU 24 via a motor driver 30. The motor driver 30 is a developing roller driving unit.

The mixer 27 has a shaft parallel to the shaft of the magnet roller 26, and a blade unit or protrusion on the outer circumferential surface of the shaft. The shaft of the mixer 27 is rotated by a gear which meshes with a gear attached to a motor 31. The motor 31 is driven by the CPU 24 via a motor driver 32. Motor driver 32 is a developer stirring member driving unit.

Similarly, the mixer 28 has a shaft and a blade unit or protrusion on the outer circumferential surface of the shaft. The shaft of the mixer 28 is rotated by a gear which meshes with a gear attached to the motor 31.

As the mixers 27 and 28 stir and carry the developer and cause the developer to circulate in a chamber 33, the developer is sent toward the magnet roller 26.

In the container 25, a toner concentration sensor 34 which detects the concentration of toner in the developer is provided. A permeability sensor is used for the toner concentration sensor 34. An output voltage of the toner concentration sensor 34 is inputted to the CPU 24 as concentration information.

In an upper part of the container 25, an opening 35 connected to the chamber 33 is formed. Scattered toner is sucked through the opening 35.

Moreover, a duct 36 is provided on the rear side of the casing 2, near the developing device 20.

The duct 36 has a suction port 37 and an exhaust port 38. The suction port 37 is opened near the opening 35 of the developing device 20. The exhaust port 38 is opened near the rear-side wall surface of the casing 2.

For example, the suction port 37 has an elongate shape along the axial direction of the photoconductive drum 18.

A fan 39 is provided in the exhaust port 38. The fan 39 is a fan which sucks scattered toner. The fan 39 is rotated by a motor 40. The motor 40 is a fan motor.

The motor 40 is driven by the CPU 24 via a motor driver 41. The motor driver 41 is a fan driving unit. The rotation of the fan 39 generates an air flow from the suction port 37 toward the exhaust port 38.

As the CPU 24 drives the motor driver 41, air in the developing device 20 and air in the duct 36 are sucked. By this suction of air, scattered toner generated in the developing device 20 is guided toward the other end of the duct 36.

Referring again to FIG. 1, the intermediate transfer roller 21 transfers the toner image on the photoconductive drum 18 to an intermediate transfer belt 42. The intermediate transfer belt 42 is wound in an endless form over plural rollers 43.

The intermediate transfer roller 21 is a transfer device. The intermediate transfer belt 42 is a recording target medium.

The second image forming unit 15, the third image forming unit 16 and the fourth image forming unit 17 have substantially the same configuration as that of the first image forming unit 14.

The four motor drivers 23 of the first to fourth image forming units 14 to 17 are controlled by the single CPU 24. The CPU 24 is enabled to separately rotate the four motors 22.

A laser unit 44 is provided below the first to fourth image forming units 14 to 17.

Moreover, a cartridge holder 45 is provided above the intermediate transfer belt 42. The cartridge holder 45 houses a first toner cartridge 46, a second toner cartridge 47, a third toner cartridge 48 and a fourth toner cartridge 49.

The first toner cartridge 46 has a container 51 having an opening 50 for toner filling. The container 51 has a chamber for storing toner. The container 51 has a screw 53 which moves the toner in this chamber to a discharge port 52, and a stirring member 54 which stirs the toner in the chamber.

The screw 53 and the stirring member 54 are rotatably supported in the container 51. A motor 69 is attached to the shafts of the screw 53 and the stirring member 54. The motor 69 is driven by the CPU 24 via a motor driver 70.

The CPU 24 drives the motor driver in accordance with the comparison between the toner concentration detected by the toner concentration sensor 34 (FIG. 2) and a predetermined threshold value.

A toner replenishment path 55 is provided on the rear side of the casing 2. The toner replenishment path 55 is provided between the discharge port 52 of the first toner cartridge 46 and the developing device 20 of the first image forming unit 14.

The CPU 24 manages the operation of the developing device 20 in two types of modes. The first mode is an ordinary print mode. The second mode is a forced toner replenishment mode. The two types of modes will be described later.

The second toner cartridge 47, the third toner cartridge 48 and the fourth toner cartridge 49 have substantially the same configuration as that of the first toner cartridge 46.

The second toner cartridge 47 supplies blue-green toner to the developing device 20 of the second image forming unit 15 via a toner replenishment path 56 in accordance with an instruction from the CPU 24.

The third toner cartridge 48 supplies reddish purple toner to the developing device 20 of the third image forming unit 16 via a toner replenishment path 57 in accordance with an instruction from the CPU 24.

The fourth toner cartridge 49 supplies yellow toner to the developing device 20 of the fourth image forming unit 17 via a toner replenishment path 58 in accordance with an instruction from the CPU 24.

The first to fourth toner cartridges 46 to 49 are provided with a toner replenishment mechanism, not shown, which supplies toner. Alternatively, the toner replenishment mechanism is provided in the developing devices 20. The toner replenishment mechanism is a developer replenishment mechanism.

In accordance with an instruction given by the CPU 24 to the toner replenishment mechanism, the toner replenishment mechanism supplies toner from the first toner cartridge 46 to the developing device 20 via the toner replenishment path 55.

Thus, in each of the first to fourth image forming units 14 to 17 of the color copy machine 1, the laser unit 44 casts light corresponding to image information to the photoconductive drum 18.

On the outer circumferential surface of the photoconductive drum 18 in each of the image forming units 14 to 17 corresponding to each color, an electrostatic latent image of a color to be developed is formed.

In the color copy machine 1, the electrostatic latent image formed on the outer circumferential surface of the photoconductive drum 18 of each of the first to fourth image forming units 14 to 17 is developed by the developing device 20 with toner of a desired color and visualized as a toner image.

The toner images of the four colors are formed by the first to fourth image forming units 14 to 17. The toner images of the four colors are sequentially transferred to the intermediate transfer belt 42 via the intermediate transfer roller 21 and superimposed on each other on this intermediate transfer belt 42.

When the superimposition of the toner images of the four colors on the intermediate transfer belt 42 is finished, a sheet guided from one paper feed cassette 6 to the carrying path 7 is guided to the position of the intermediate transfer belt 42 via the registration roller 9.

The toner images of the four colors superimposed on the intermediate transfer belt 42 are transferred to the sheet via the transfer roller 10.

The full-color image transferred to the sheet is fixed to the sheet by the fixing device 11. The sheet having the full-color image fixed thereto is guided to the paper discharge tray 5 through the carrying path 7.

Hereinafter, a method for controlling the operation of the fan 39 in the electrographic recording apparatus will be described.

Figure 3:
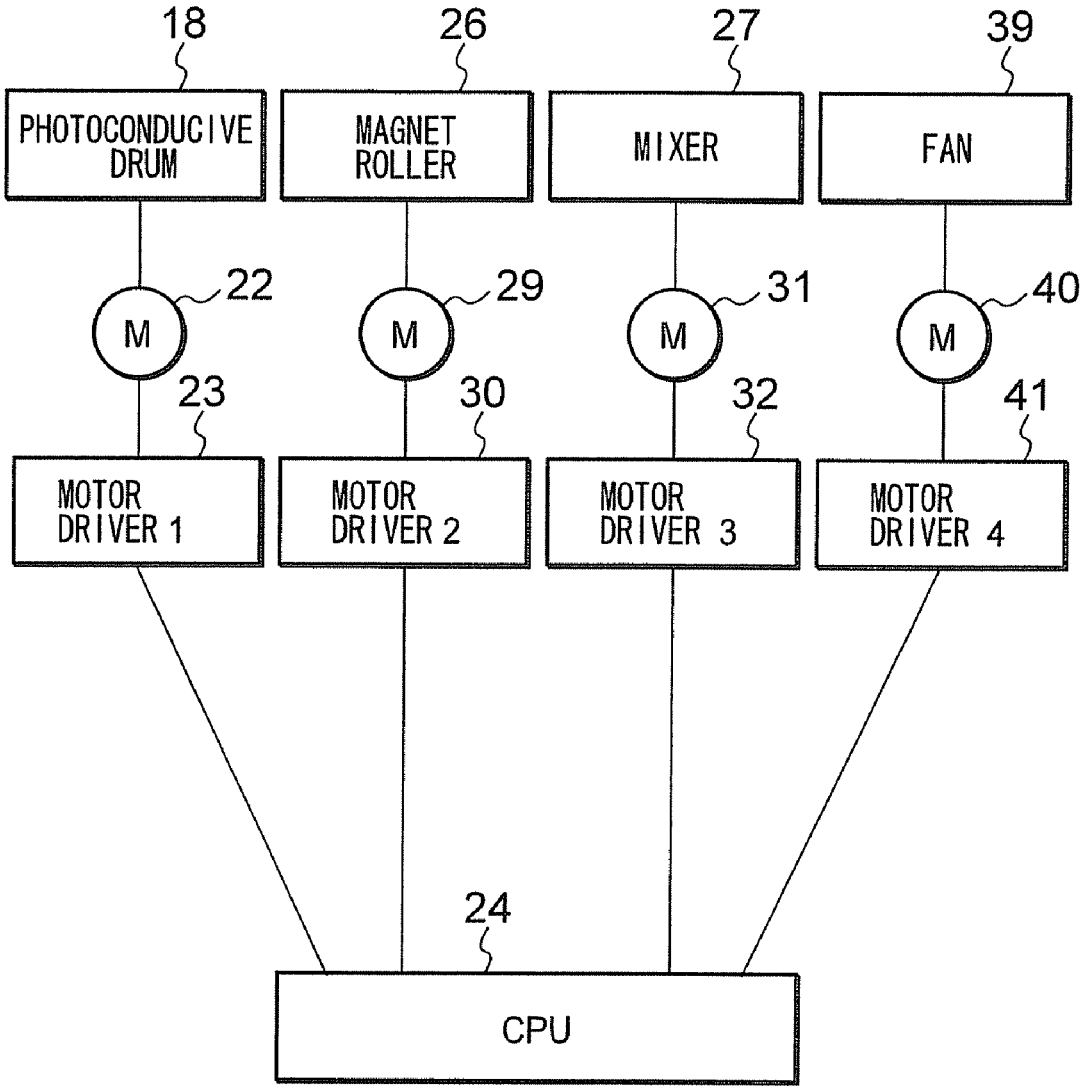
FIG. 3 is a block diagram of a motor control system for one color in an image forming apparatus according to an embodiment.

FIG. 3 is a block diagram of a motor control system for one color.

Separate motors 22, 29 and, 31 are used for the photoconductive drum 18, the magnet roller 26 and the mixer 27, respectively. The motor 31 drives the mixer 27, which in turn drives the mixer 28.

The CPU 24 is capable of separately driving the photoconductive drum 18, the magnet roller 26, the mixer 27, and fan 39 that sucks scattered toner, in the first image forming unit 14.

The CPU 24 is also capable of separately driving the photoconductive drums 18 for the four colors. The CPU 24 is capable of separately driving the photoconductive drum 18, the magnet roller 26, the mixer 27 and the fan 39, for each color.

Driving timing of the motors 22, 29, 31 and 40 for sucking scattered toner in the color copy machine 1 with the above configuration will now be described. An example with the first image forming unit 14 will be described.

FIG. 4A to FIG. 4E show timing for the CPU 24 of the color copy machine 1 to drive the motors 22, 29, 31 and 40. "High" of the logic indicates that driving is on. "Low" of the logic indicates that driving is off. The horizontal axis represents time.

Figures 4A, 4B, 4C, 4D, 4E:
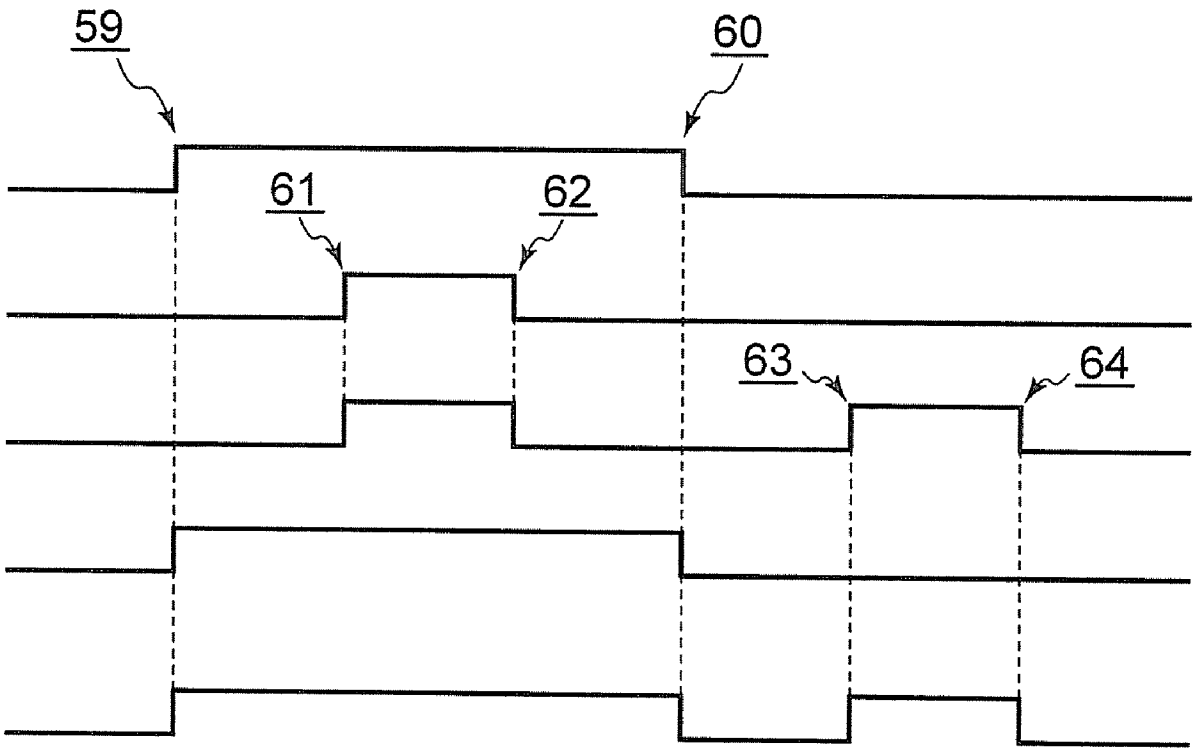
FIG. 4D (RELATED ART)
FIG. 4A to FIG. 4E show timing for the CPU of the image forming apparatus according to the embodiment to drive plural motors.

FIG. 4A is a timing chart showing timing when the photoconductive drum 18 is driven. FIG. 4B is a timing chart showing timing when the magnet roller 26 is driven. FIG. 4C is a timing chart showing timing when the mixer 27 as a developer stirring member is driven.

FIG. 4D is a timing chart showing timing when a fan for sucking scattered toner according to related art is driven. FIG. 4E is a timing chart showing timing when the fan 39 for sucking scattered toner used in the color copy machine 1 is driven.

A button to start printing is provided on the casing 2. The CPU 24 detects that the button is pressed by a person. The CPU 24 causes the first image forming unit 14 to start an image forming process.

The CPU 24 starts rotating the motor 22 of the photoconductive drum 18 at a time 59, as shown in FIG. 4A. The CPU 24 stops rotating the motor 22 at a time 60.

The CPU 24 causes the developing device 20 to start applying a development bias to the magnet roller 26. The CPU 24 starts rotating the motor 29 of the magnet roller 26 at a time 61, as shown in FIG. 4B.

The time 61 is the time when development on the photoconductive drum 18 starts. The CPU 24 stops rotating the motor 29 at a time 62.

The CPU 24 rotates the motor 31 shared by the mixers 27 and 28 for the same length of time as the time the motor 29 of the magnet roller 26 is driven, as shown in FIG. 4C.

The CPU 24 rotates the motor 40 of the fan 39 from the time 59 to the time 60, as shown in FIG. 4E, in order to suck scattered toner. With the rotation of the motor 40, toner in the development area and its vicinity is sucked.

While the first image forming unit 14 is carrying out printing, the CPU 24 causes all of the photoconductive drum 18, the magnet roller 26 and the mixers 27 and 28 to operate.

The operation of the first image forming unit 14 during the time indicated on the right in FIG. 4C will be described further.

As the first image forming unit 14 finishes printing, the CPU 24 instructs the motor driver 23, the motor driver 30 and the motor driver 32 to stop the operation of the photoconductive drum 18, the magnet roller 26 and the mixers 27 and 28.

During the period after the first image forming unit 14 finishes the previous print job and before the first image forming unit 14 starts the next print job, the CPU 24 causes the motor driver 23, the motor driver 30 and the motor driver 32 to carry out follow-up toner replenishment.

Moreover, while the first image forming unit 14 is not carrying out any print job after finishing processing to carry a sheet, the CPU 24 carries out forced replenishment of the developing device 20 with a developer.

The CPU 24 compares concentration information from the toner concentration sensor 34 with a reference concentration which the CPU 24 holds in advance.

If the CPU 24 determines that toner concentration is lowered in accordance with the result of the comparison, the CPU 24 changes the mode of the developing device 20 to a forced toner replenishment mode. The CPU 24 causes the toner replenishment mechanism to start operating. The toner replenishment mechanism moves toner from the toner cartridge 46 to the developing device 20.

Then, the CPU 24 starts rotating the motor 31 at a time 63, as shown in FIG. 4C. While the CPU 24 is rotating the motor 31, the CPU 24 continues reading the voltage value from the toner concentration sensor 34.

If the CPU 24 determines that the reference value of toner concentration is reached as a result of stirring the toner, the CPU 24 stops the operation of the toner replenishment mechanism. The CPU 24 stops rotating the motor 31 at a time 64.

While the motor 40 rotates from the time 63 to the time 64, the CPU 24 continues rotating the motor 40 of the fan 39, as shown in FIG. 4E. The toner in the developing device 20 which is scattered while being stirred is sucked.

The container 25 of the developing device 20 is not sealed up. Therefore, as the mixers 27 and 28 rotate, toner is scattered even if the quantity of rotation of the mixers 27 and 28 is small.

The container 25 has an opening at a position facing the photoconductive drum 18. Through this opening, the outer circumferential surface of the magnet roller 26 is exposed to the outside of the container. The container 25 has a gap near the development area. Toner leaking from this gap is sucked by the rotation of the fan 39.

Thus, scattered toner generated in the operation in the forced toner replenishment mode is sucked without involving rotation of the photoconductive drum 18.

The timing of the motors 22 of the photoconductive drums 18 in the second to fourth image forming units 15 to 17 is the same as each timing shown in FIG. 4A, FIG. 4B, FIG. 4C and FIG. 4E.

Figure 5:
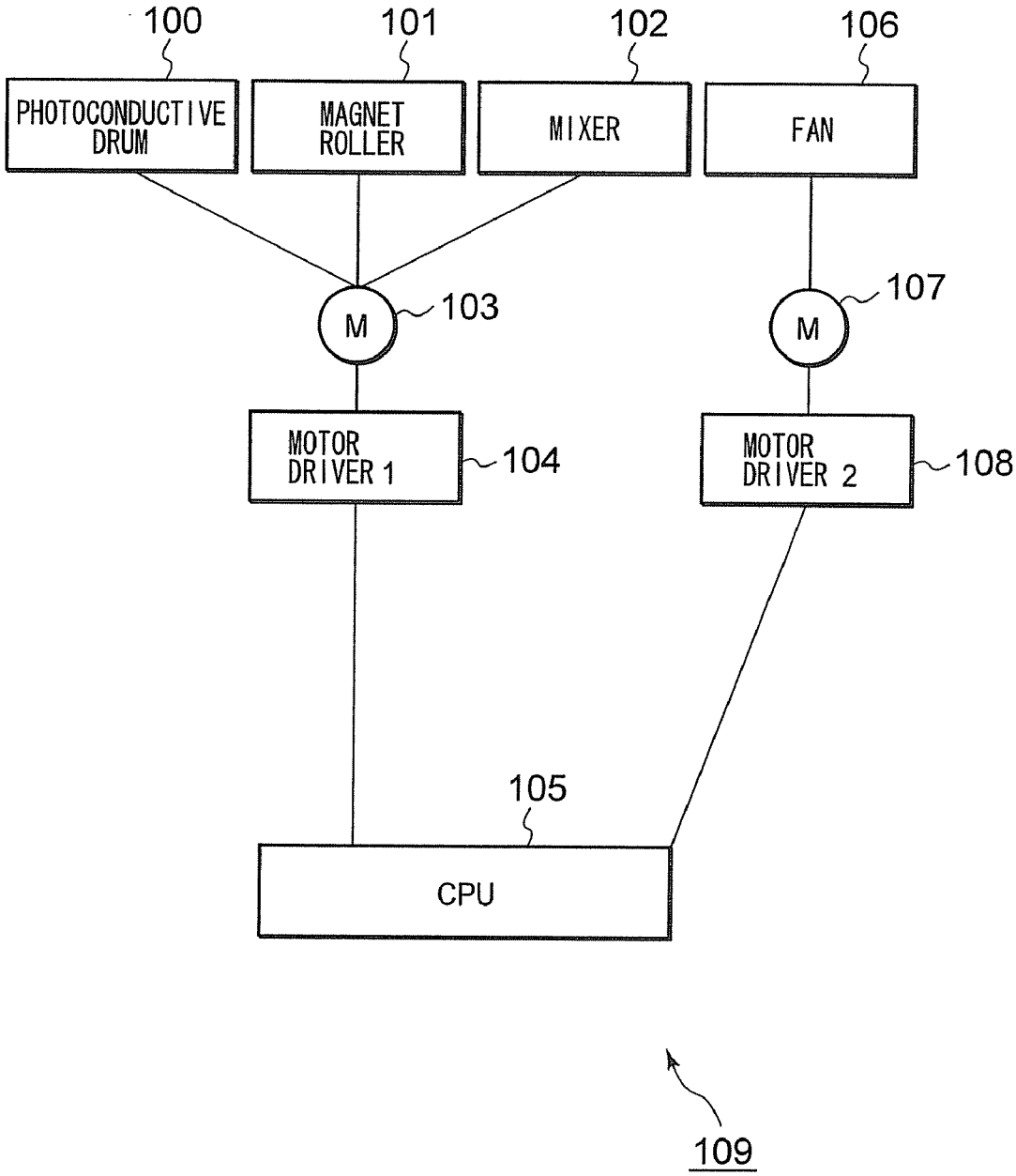
FIG. 5 is a block diagram of a motor control system according to related art.

FIG. 5 is a block diagram of a motor control system according to related art. All of a photoconductive drum 100, a magnet roller 101 and a mixer 102 are rotated by a single motor 103 via a driving force transmission mechanism. The motor 103 is driven by a CPU 105 via a motor driver 104.

A fan 106 for sucking scattered toner is rotated by another motor 107. The motor 107 is driven by the CPU 105 via a motor driver 108.

In the motor control system 109 shown in FIG. 5, the CPU 105 drives the fan 106 in the same timing as the rotation of the photoconductive drum 100.

During printing, since the photoconductive drum 100 is rotated by the motor 103, the mixer 102 is rotated by the motor 103 as well.

In operation in the forced toner replenishment mode, the CPU 105 drives only the mixer 102. Since the motor driver 104 and the motor driver 108 are separate from each other, the CPU 105 cannot drive the mixer 102 alone.

In the driving force transmission mechanism, when the CPU 105 causes the developing device including the magnet roller 101 and the mixer 102 to operate in the forced toner replenishment mode, the CPU 105 cannot cause the fan 106 to suck scattered toner generated by the driving of the motor 103.

In other words, in the example of FIG. 5, the photoconductive drum 100, the magnet roller 101 and the mixer 102 as a developer stirring member use the single motor 103. The photoconductive drum 100, the magnet roller 101 and the mixer 102 are rotationally driven via a gear or the like by the motor 103 shared by the photoconductive drum 100, the magnet roller 101 and the mixer 102.

Meanwhile, in the color copy machine 1, the photoconductive drum 18, the magnet roller 26 and the mixer 27 are driven by the separate motors 22, 29 and 31, respectively, as in the example of FIG. 3.

In the developing device 20, the mixers 27 and 28 as developer stirring members need to be rotated whenever the magnet roller 26 rotates. This is because stirring in the forced toner replenishment mode is necessary.

In the image forming apparatus according to the embodiment, if at least one of the motor 31 as the driving unit of the photoconductive drum 18 and the motor 27 as the driving unit of the mixers 27 and 28 is operating, the CPU 24 causes the motor driver 41 as the driving unit of the scattered toner suction fan 39 to operate.

Thus, the scattered toner is sucked by the scattered toner suction fan 39 without failure. The toner can be prevented from being scattered in and out of the machine.

Conventionally, on and off timing of the operation of the fan motor is simultaneous as on and off timing of the operation of the photoconductive drum.

However, recently, in order to secure fixability according to media such as normal paper, thick paper and other special types of paper, the full-color electrographic printing apparatus may cope with plural image forming process speeds.

In this case, if a common motor is used as the motor which drives the photoconductive drum and as the motor which drives the developing device, the charging property and carrying property of the developer are changed by change in process speed according to color. Consequently, there is a problem of reduced stability of an image.

In the electrographic printing apparatus having plural image forming process speeds, separate driving of the magnet roller and the developer stirring member by the CPU leads to acquisition of a highly stable image.

In the image forming apparatus according to the embodiment, since the magnet roller 26 and the mixers 27 and 28 as developer stirring members are separately driven, stability of an image is secured.

If the CPU 24 separately drives the magnet roller 26 and the mixers 27 and 28, in forced toner replenishment at the time of job end or when turning on and off power, the CPU 24 drives only the developer stirring members while keeping the motor 22 of the photoconductive drum 18 and the motor 29 of the magnet roller 26 in non-operating state.

In the image forming apparatus according to the embodiment, control is carried out so that the developer which contains toner is stirred. Thus, the moving distance of the periodically replaced components can be reduced. Consequently, deterioration of the photoconductive drum 18 and the developing device 20 can be restrained.

Even if the image forming apparatus according to the embodiment causes the scattered toner suction fan to operate in the same timing as the timing according to the related art, and the operation of the photoconductive drum 18 and the magnet roller 26 is off while the motor 31 of the developer stirring member operates, the operation of the scattered toner suction fan 39 can be turned on.

As a result, the scattered toner suction fan 39 can suck toner which is scattered from the developing device 20 as the motor 31 driving the developer stirring members is driven. Scattering of toner within the casing 2 is prevented.

In the embodiment, during printing, the CPU 24 drives the motor 40 of the fan 39 and then stops the motor 40, as shown in FIG. 4E. The CPU 24 starts driving the motor 40 again when operating in the forced toner replenishment mode.

An image forming apparatus according to a first modification of the one embodiment can keep rotating the fan 39 without stopping the driving of the motor 40.

Figures 6A, 6B, 6C, 6D, 6E:
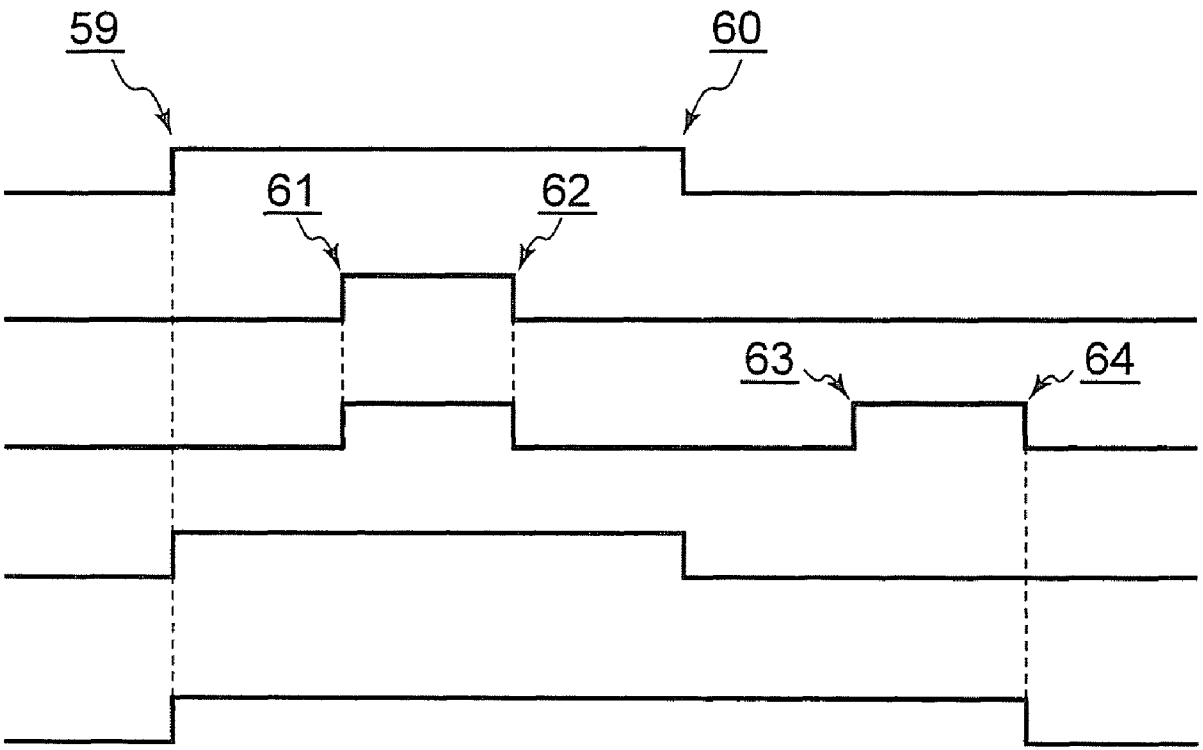
FIG. 6D (RELATED ART)
FIG. 6A to FIG. 6E show timing for the CPU of an image forming apparatus according to a first modification of the embodiment to drive plural motors.

FIG. 6E is a timing chart showing timing when the fan motor used in the image forming apparatus according to the first modification is driven. FIG. 6A, FIG. 6B, FIG. 6C and FIG. 6D show the same timing as FIG. 4A, FIG. 4B, FIG. 4C and FIG. 4D, respectively.

With respect to the reference numerals shown in FIG. 6A to FIG. 6E, the elements having the same reference numerals as the above-described reference numerals represent the same elements.

As shown in FIG. 6E, the CPU 24 drives the motor 40 after printing is finished and until the forced toner replenishment mode is started.

Therefore, the fan 39 keeps rotating until the mixer 27, which is rotating for follow-up replenishment after the photoconductive drum 18 starts rotating, stops.

Thus, scattered toner is sucked more securely.

An image forming apparatus according to a second modification of the one embodiment may start driving the motor 40 at an earlier time. The image forming apparatus according to the second modification of the one embodiment may stop driving the motor 40 at a later time.

Figures 7A, 7B, 7C, 7D, 7E:
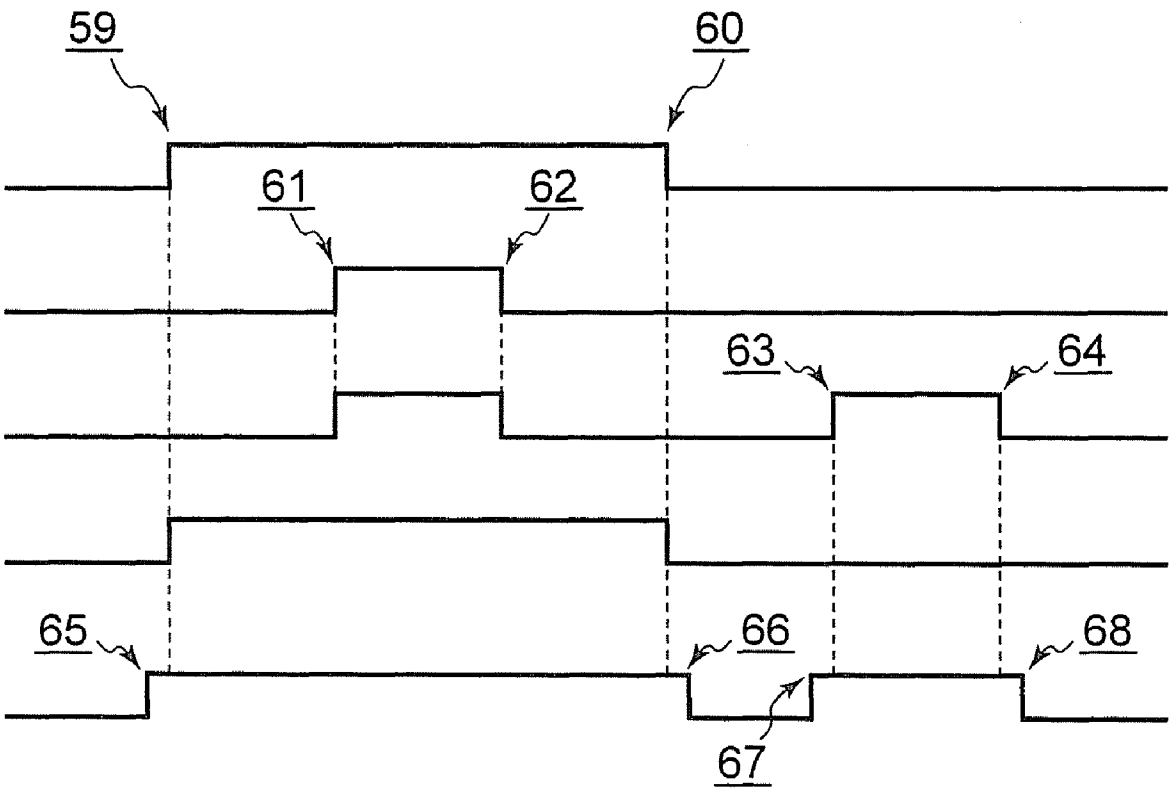
FIG. 7D (RELATED ART)
FIG. 7A to FIG. 7E show timing for the CPU of an image forming apparatus according to a second modification of the embodiment to drive plural motors.

FIG. 7E is a timing chart showing timing when the fan motor used in the image forming apparatus according to the second modification is driven. FIG. 7A, FIG. 7B, FIG. 7C and FIG. 7D show the same timing as FIG. 4A, FIG. 4B, FIG. 4C and FIG. 4D, respectively.

With respect to the reference numerals shown in FIG. 7A to FIG. 7E, the elements having the same reference numerals as the above-described reference numerals represent the same elements.

As shown in FIG. 7E, during printing, the CPU 24 starts driving the motor 40 at an earlier time 65 than the time 59. The CPU 24 stops driving the motor 40 at a later time 66 than the time 60.

In the forced toner replenishment mode, the CPU 24 starts driving the motor 40 at an earlier time than the time 63. The CPU 24 stops driving the motor 40 at a later time 68 than the time 64.

That is, the CPU 24 starts rotating the motor 40 of the scattered toner suction fan 39 before starting to rotate the photoconductive drum 18. Even after the rotation of the photoconductive drum 18 ends, the CPU 24 keeps rotating the motor 40 for a while and then turns off the operation of the motor 40.

Alternatively, the CPU 24 starts rotating the motor 40 before starting to rotate the motor 31 of the developer stirring member. After turning off the motor 40, the CPU 24 keeps rotating the motor 39 for a while and then turns the motor 39 off.

Since there is a time lag, toner leaking from the gap of the developing device is sucked without failure. As the toner is sucked without failure, the inside of the machine is not contaminated.

Since the CPU 24 causes the motor 40 to run preliminarily, the suction force generated by the operation of the fan 39 becomes stable.

Startup for the start of operation is done to a certain extent. If the rotation of the fan is slow, the suction force is weak. The motor 40 runs preliminarily, and when the wind speed generated by the driving of the motor 40 reaches a predetermined level, rotation of the developer stirring members 27 and 28 can be started. There is little contamination within the casing 2.

In the embodiment, the position of the fan 39 is near the discharge port 38 of the duct 36. The position of the fan 39 can be changed to various positions such as a halfway point in the path through which air in the duct 36 flows. The shape of the duct 36 can be changed to various shapes.

Although an intermediate transfer method is used in the embodiment, the image forming apparatus according to the embodiment may be an apparatus using a direct transfer method. The recording target medium for the apparatus using a direct transfer method is a paper or OHP (overhead projector) sheet.

Although exemplary embodiments of the present invention have been shown and described, it will be apparent to those having ordinary skill in the art that a number of changes, modifications, or alterations to the invention as described herein may be made, none of which departs from the spirit of the invention. All such changes, modifications, and alterations should therefore be seen as within the scope of the invention.

What is claimed is:

1. An image forming apparatus comprising:

an image carrier on which an electrostatic latent image is carried;

an image carrier driving unit that drives an image carrier motor rotating the image carrier;

a container which has a chamber containing a developer and an opening connected to the chamber;

a developing roller provided in the container and having its outer circumferential surface exposed from the opening;

a transfer device that transfers a developer image generated on the image carrier by the developing roller to a recording target medium;

a developing roller driving unit that drives a developing roller motor rotating the developing roller;

a developer stirring member that is rotatably provided in the container and stirs the developer;

a developer stirring member driving unit that drives a developer stirring member motor rotating the developer stirring member;

a duct that has a suction port connected to the chamber in the container and a discharge port opening to outside of the container, and guides air including the developer scattered in the container from the suction port to the discharge port;

a fan provided in a path through which air flows;

a fan driving unit that drives a fan motor rotating the fan; and a control unit that separately drives the image carrier driving unit, the developing roller driving unit and the developer stirring member driving unit, and causes the fan driving unit to operate if at least one of the image carrier driving unit and the developer stirring member driving unit is operating.

2. The apparatus according to claim 1, further comprising a developer replenishment mechanism that supplies a supply of developer into the container, wherein after causing the image carrier driving unit, the developing roller driving unit and the developer stirring member driving unit to carry out operation of an image forming process, the control unit causes the developer replenishment mechanism to carry out follow-up replenishment to supply the developer following the image forming process or forced replenishment to forcedly supply the developer.

3. The apparatus according to claim 2, wherein after causing the image carrier driving unit to start operating, the control unit causes the fan driving unit to continuously operate until before the follow-up replenishment or the forced replenishment is started.

4. The apparatus according to claim 2, wherein while the image forming processing is executed, the control unit starts operation of the fan driving unit a predetermined time before timing of starting operation of the image carrier driving unit, and ends the operation of the fan driving unit a predetermined time after timing of ending the operation of the image carrier driving unit.

5. The apparatus according to claim 2, wherein while the follow-up replenishment or the forced replenishment is executed, the control unit starts operation of the fan driving unit a predetermined time before timing of starting operation of the developer stirring member driving unit, and ends the operation of the fan driving unit a predetermined time after timing of ending the operation of the developer stirring member driving unit.

6. The apparatus according to claim 2, further comprising a toner concentration detecting unit that is provided in the chamber of the container and detects concentration of toner in the developer, wherein the control unit compares a target value that is stored in advance with the toner concentration detected by the toner concentration detecting unit, and uses a result of the comparison as a trigger for driving the developer replenishment mechanism.

7. The apparatus according to claim 6, wherein if the toner concentration is lower than the target value, the control unit switches an operation mode of the developer replenishment mechanism to a mode of the follow-up replenishment or the forced replenishment.

8. The apparatus according to claim 1, further comprising the image carrier, the container, the developing roller, the transfer device, the developer stirring member, the duct, the fan, the image carrier driving unit, the developing roller driving unit, the developer stirring member driving unit, and the fan driving unit, corresponding to each of plural colors, wherein the control unit separately drives the image carrier driving unit, the developing roller driving unit and the developer stirring member driving unit, for each color.

9. The apparatus according to claim 2, wherein a driving force from the developer stirring member motor acts on the developer replenishment mechanism.

10. The apparatus according to claim 1, further comprising a driving force transmission mechanism that receives a rotational driving force of the image carrier motor and causes the rotational driving force to act on the image carrier.

11. An image forming method comprising:

a controller capable of separately driving an image carrier driving unit, a developing roller driving unit, a developer stirring member driving unit and a fan driving unit, causing the image carrier driving unit to drive an image carrier motor rotating an image carrier, and thereby causing the image carrier to have an electrostatic latent image generated thereon;

the control unit causing the developer stirring member driving unit to drive a developer stirring member motor rotating a developer stirring member which is rotatably provided in a container having a chamber housing a developer and an opening connected to the chamber, and stirs the developer, and thereby causing the developer stirring member to carry the developer;

the control unit causing the fan driving unit to drive a fan motor rotating a fan provided in a path, in a duct having a suction port connected to the chamber in the container and a discharge port opening to outside of the container and guiding air containing the developer scattered in the container from the suction port to the discharge port, the path through which the air flows;

the control unit causing the developing roller driving unit to drive a developing roller motor rotating a developing roller which is provided in the container and has its outer circumferential surface exposed from the opening, and thereby causing the developing roller to develop the electrostatic latent image;

a transfer device which transfers a developer image generated on the image carrier to a recording target medium, transferring the developer image to the recording target medium; and the control unit causing the fan driving unit to operate if the developer stirring member driving unit is caused to operate.

12. The method according to claim 11, wherein after causing the image carrier driving unit, the developing roller driving unit and the developer stirring member driving unit to carry out operation of an image forming process, the control unit causes a developer replenishment mechanism which supplies a supply of developer into the container, to carry out follow-up replenishment to supply the developer following the image forming process or forced replenishment to forcedly supply the developer.

13. The method according to claim 12, wherein after causing the image carrier driving unit to start operating, the control unit causes the fan driving unit to continuously operate until before the follow-up replenishment or the forced replenishment is started.

14. The method according to claim 12, wherein while the image forming processing is executed, the control unit starts operation of the fan driving unit a predetermined time before timing of starting operation of the image carrier driving unit.

15. The method according to claim 14, wherein the control unit ends the operation of the fan driving unit a predetermined time after timing of ending the operation of the image carrier driving unit.

16. The method according to claim 12, wherein while the follow-up replenishment or the forced replenishment is executed, the control unit starts operation of the fan driving unit a predetermined time before timing of starting operation of the developer stirring member driving unit.

17. The method according to claim 16, wherein the control unit ends the operation of the fan driving unit a predetermined time after timing of ending the operation of the developer stirring member driving unit.

18. The method according to claim 12, wherein the control unit compares a target value that is stored in advance with a toner concentration detected by a toner concentration detecting unit which detects concentration of toner in the developer, and uses a result of the comparison as a trigger for driving the developer replenishment mechanism.

19. The method according to claim 18, wherein if the toner concentration is lower than the target value, the control unit switches an operation mode of the developer replenishment mechanism to a mode of the follow-up replenishment or the forced replenishment.

20. The method according to claim 11, wherein the image carrier, the container, the developing roller, the transfer device, the developer stirring member, the duct, the fan, the image carrier driving unit, the developing roller driving unit, the developer stirring member driving unit, and the fan driving unit are provided corresponding to each of plural colors, and the control unit separately drives the image carrier driving unit, the developing roller driving unit and the developer stirring member driving unit, for each color.

* * * * *